United States Patent [19]

Junkers

[11] 4,233,865

[45] Nov. 18, 1980

[54] HYDRAULIC WRENCH

[76] Inventor: John K. Junkers, 7 Arrow Head La., Saddle River, N.J. 07458

[21] Appl. No.: 35,469

[22] Filed: Apr. 25, 1979

[51] Int. Cl.[3] ..... B25B 13/00

[52] U.S. Cl. ..... 81/57.44; 81/57.39

[58] Field of Search ..... 81/57.44, 57.46, 57.39; 92/76, 73

[56] References Cited

U.S. PATENT DOCUMENTS

| | | | |
|---|---|---|---|
| 665,281 | 1/1901 | Stevenson | 81/57.46 |
| 2,836,090 | 5/1958 | Ray | 81/57.46 |
| 4,027,561 | 6/1977 | Junkers | 81/57.39 |
| 4,086,830 | 5/1978 | Latham | 81/57.39 |

*Primary Examiner*—James L. Jones, Jr.
*Attorney, Agent, or Firm*—Michael J. Striker

[57] ABSTRACT

A hydraulic wrench includes a housing formed with two parallel cylinder bores in which axially displaced pistons are guided movable between an active forward stroke and a return stroke. A pair of piston rods are each pivotally connected at one of the ends thereof to a respective one of said pistons and at the other ends pivotally connected to a pair of drive arms which are freely turnably mounted on a shaft, which in turn is mounted for rotation about an axis normal to and transversely spaced from the cylinder bores. At least one pair of ratchet gears are mounted on the shaft for rotation therewith, with the teeth on one gear displaced in circumferential direction with respect to the teeth on the other gear, and at least one pair of pawls are pivotally carried by the drive arms for respectively engaging with the teeth of the two ratchet gears to rotate the shaft in one direction during the active forward stroke of each piston. The shaft carries an exchangeable socket for turning a threaded connector engaged in the socket during rotation of the shaft, whereby during such turning of the threaded connector in one direction a counterforce is created tending to turn the housing about the axis of the shaft in the opposite direction. A plate connected to the housing is adapted to engage a fixed abutment adjacent to the threaded connector to be turned to thus counteract this force.

16 Claims, 6 Drawing Figures

HYDRAULIC WRENCH

BACKGROUND OF THE INVENTION

The present invention relates to hydraulic wrenches, and more particularly to hydraulic wrenches which can be advantageously used for tightening and loosening threaded connectors, such as nuts mounted on bolts, in which a plurality of nuts which are closely adjacent to each other have to be tightened or loosened and in which the overhead clearance for applying a wrench to the nuts is rather limited, which would make it impossible to use a standard air or impact wrench.

More specifically, the present invention relates to a hydraulic wrench in which the forces created during turning a threaded connector in one direction and tending to turn the whole wrench in the opposite direction are taken up by means connected to the wrench and adapted to engage a fixed abutment adjacent to the threaded connector to be turned.

Such a hydraulic wrench is known in the art, as for instance disclosed in the U.S. Pat. No. 4,027,561.

This known hydraulic wrench has, however, certain disadvantages in that it works relatively slow and further that the torque applied by the wrench varies within ±5% of the total torque.

SUMMARY OF THE INVENTION

It is an object of the present invention to provide a hydraulic wrench which operates faster than such wrenches known in the art.

It is an additional object of the present invention to provide a hydraulic wrench which not only works faster than such wrenches known in the art, but in which the size of the torque applied by the wrench varies during operation thereof also to a smaller degree than in such wrenches known in the art.

It is a further object of the present invention to provide a hydraulic wrench which is of compact construction so that it can be easily handled by the operator.

It is yet an additional object of the present invention to provide a hydraulic wrench which is composed of relatively few and simple parts so that the wrench may be manufactured at reasonable cost and stand up properly under extended use.

With these and other objects in view, which will become apparent as the description proceeds, the hydraulic wrench according to the present invention mainly comprises a housing in the main portion of which a pair of parallel cylinder bores are provided, having each an open front end and a closed rear end. A pair of axially displaced piston means are respectively mounted in the cylinder bores, each movable between an active forward stroke and a return stroke and these piston means form with the closed ends of the bores a pair of compartments. A pair of piston rods are provided, each pivotally connected at one end to a respective one of the pair of piston means. The wrench includes further a shaft mounted on a forwardly projecting portion of the housing for rotation about an axis substantially normal to the cylinder bores and transversely spaced therefrom. A pair of ratchet gear means are fixed to the shaft for rotation therewith and each of the pair of ratchet gears means has the same number of teeth, with the teeth of one of the ratchet gear means displaced in circumferential direction relative to those of the other ratchet gear means through substantially half a pitch. A pair of drive arms are pivotally mounted at one of the ends thereof on the aforementioned shaft and pivotally connected at the other ends to the other ends of the piston rods. The drive arms respectively carry pawl means pivotally connected thereto intermediate the ends thereof and respectively engaging the teeth of the pair of ratchet gear means for rotating the shaft during movement of each of the piston means along its active forward stroke. An exchangeable socket is connected to an end portion of the shaft projecting beyond the ratchet gear means for turning a threaded connector engaged in the socket during rotation of the shaft, whereby during such rotation of the threaded connector in one direction a force is created tending to turn the housing about the axis of the shaft in the opposite direction, and means adapted to engage a fixed abutment adjacent to the threaded connector to be turned are provided on the main portion of the housing for counteracting this force. The wrench includes further valve means in communication with the aforementioned compartments for alternatingly feeding pressure fluid into one of the compartments and for discharging pressure fluid from the other compartment so that during the return stroke of one of the piston means the other of the piston means will perform in its active stroke, whereby the shaft is continuously rotated.

While in the hydraulic wrenches known in the art in which only a single drive piston is provided, the shaft of the wrench is rotated only during the active forward stroke of the single piston, while during the return stroke of this single piston the shaft will remain at a standstill, the wrench of the present invention will produce a continuous rotation of the shaft since during the return stroke of one of the pistons the other axially displaced piston will make its active stroke.

The hydraulic wrench according to the present invention further permits a drastic improvement of torque accuracy through an increased amount of ratchet teeth and concomitant reductions of the length of the stroke of each piston without effecting the operating speed of the wrench. This in turn permits a drastic size reduction of the cylinders so that the weight of the hydraulic wrench according to the present invention will be substantially identical to a one cylinder hydraulic wrench, as the increase in width due to the two parallel cylinders can be offset by cutting the cylinder length in half.

As compared with hydraulic wrenches known in the art, the hydraulic wrench according to the present invention has the advantages that its operating speed is twice as fast, and that it has a 50% better torque accuracy, while being of the same weight as such hydraulic wrenches known in the art.

Since operating speed and torque accuracy are critical features of hydraulic wrenches, the hydraulic wrench according to the present invention is greatly improved over such hydraulic wrenches known in the art.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 3:
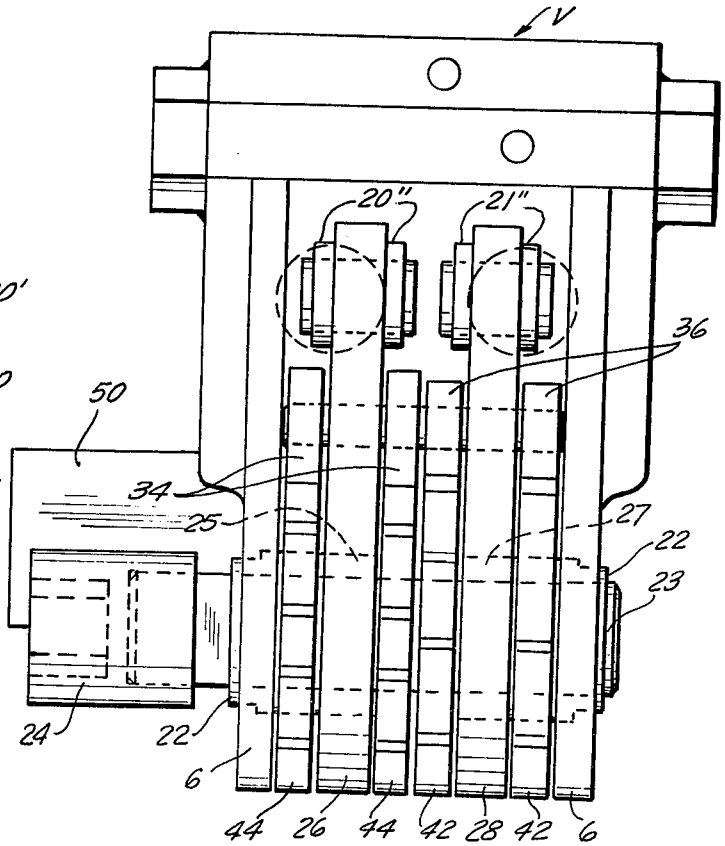
FIG. 3 is a front view as viewed in the direction of the arrow A shown in FIG. 2.
Figure 1:
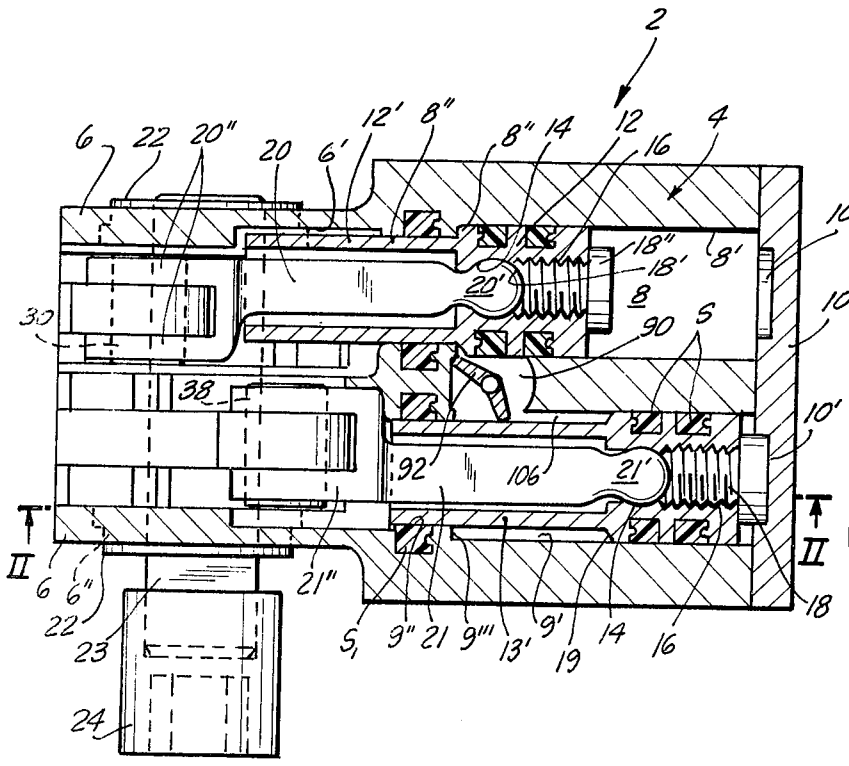
FIG. 1 is a cross-section through the hydraulic wrench according to the present invention taken along the line I—I of FIG. 2.

Referring now to the drawing, it will be seen that the hydraulic wrench according to the present invention comprises housing means 2, having a main portion 4 and a forwardly projecting portion, shown in the drawing as a pair of transversely spaced side plates 6 projecting forwardly from the main portion 4 of the housing. The main portion of the housing is provided with two parallel cylinder bores 8 and 9 having each an open front end, whereas the rear end of each bore is closed by a cover 10 connected by screws, not shown in the drawing, to the planar rear face of the main portion 4 of the housing. Each of the cylinder bores 8 and 9 has a large diameter rear portion 8', respectively 9' and a smaller diameter front portion 8'', respectively 9'', which is shorter than the rear portion, to form a shoulder 8''', respectively 9''' at the junction of the respective large diameter and small diameter bore portions. A piston 12 is reciprocatably guided in the large diameter portion 8' of the cylinder bore 8 and a corresponding piston 13 is reciprocatably guided in the large diameter portion 9' of the cylinder bore 9, and as can be seen from FIG. 1, the two pistons 12 and 13 are axially displaced from each other in such a manner so that when the piston 12 reaches the end of its forward stroke, as shown in FIG. 1, the piston 13 reaches the end of its return stroke, and vice versa. Each piston is formed with an axially extending opening therethrough having an inwardly curved front portion 14 forming a substantially semi-spherical seat and a threaded rear portion 16. A screw plug 18 is screwed into the threaded rear portion 16 of each piston and each of the screw plugs has a semi-spherical front face 18' completing the seat formed by the front portion 14 of the bore through each piston, whereas a head 18'' of each screw plug projects rearwardly beyond the rear face of the respective piston. The cover 10 is provided with two cylindrical depressions 10' aligned with the aforementioned heads 18'' and in which these heads partly penetrate at the end of the return stroke of each piston, as shown in FIG. 1 for the piston 13. The piston 12 has a forwardly projecting tubular extension 12' of a smaller diameter than the piston itself and the piston 13 has likewise a tubular forwardly projecting extension 13' of smaller diameter than the piston 13. The shoulder forming at the transition of the tubular extension of each piston and the piston itself is provided at the outer circumference with a bevel 19, for a purpose as will be described later on. A piston rod 20 is connected to the piston 12 and the piston rod 20 has a spherical rear end 20' tiltably mounted in the spherical seat formed by the surface portions 14 and 18' and a forked front end 20'' projecting beyond the free end of the tubular extension 12' of the piston 12. A piston rod 21 is connected to the piston 13, and the piston rod 21 has a spherical rear end 21' tiltably mounted in the spherical seat formed by the spherical faces 14 and 18' of the piston 13, and the piston rod 21 extends through the tubular extension 13' of the piston 13 and has a forked front end 21'' located beyond the front end of the tubular extension 13'. Each of the pistons 12 and 13 is provided in the periphery thereof with a pair of axially spaced sealing rings S for properly sealing the respective piston in the corresponding cylinder bore and a pair of sealing rings $S_1$ are provided in the main housing portion 4 respectively surrounding and sealingly engaging the tubular projections 12' and 13' of each piston. The side plates 6 are each provided at the inner face thereof with cutouts 6' providing the necessary clearance for the tubular extension 12' or 13' during the forward stroke of the respective piston.

The side plates 6 are further provided with stepped bores 6' therethrough, which are aligned along a common axis transversely displaced from and normal to the axes of the cylinder bores 8 and 9. A pair of sleeves 22 are respectively arranged in the stepped bore 6' of the side plates 6 and these sleeves have outer cylindrical surfaces turnably mounted in the bores 6' and are provided with central openings of square cross-section therethrough. A shaft 23 of corresponding square cross-sections extends through the central openings of the sleeves 22 with a slide fit. As shown in FIG. 1, the shaft 23 projects with an end portion thereof beyond one of the side plates 6 and carries at this end portion a socket 24, releasably connected thereto by a set screw or the like, not shown in the drawing, and the socket 24 is adapted to engage the exagonal head of a threaded connector to be tightened or loosened by the hydraulic wrench.

A pair of drive arms 26 and 28 are turnably mounted between the side plates 6 in the region of the lower ends thereof on the outer cylindrical surfaces of sleeves 25, 27, respectively, which in turn are provided with central square openings corresponding to the cross-section of the shaft 23 through which the latter extends. The upper ends of the drive arms 26 and 28 are pivotally connected by pivot pins 30, respectively 32, between the forked ends 20'' and 21'' of the piston rods 20 and 21, respectively. Needle bearings, not shown in the drawing, may be arranged between the pivot pins 30 and 32 and the corresponding openings in the drive arms 26 and 28. The drive arm 26 carries at opposite sides thereof a pair of pawls 34, pivotally connected thereto by a pivot pin 38, and correspondingly the drive arm 28 carries at opposite sides thereof a pair of pawls 36 pivotally connected thereto by a common pivot pin 40. The pawls 34 respectively engage the teeth of ratchet gear 44 mounted on opposite sides of the drive arm 26 on the shaft 23 for rotation therewith by being provided with central openings matching the square cross-section of the shaft 23, and the pawls 36 respectively engage the teeth of the ratchet gears 42, likewise mounted to opposite sides of the drive arm 28 on the shaft 23 for rotation therewith. Leaf springs 46 and 48 are operatively connected to the pawls 34 and 36 for maintaining the free ends of the pawls in engagement with the teeth of the respective ratchet gears. As can be clearly seen from FIG. 2 the teeth of the ratchet gears 42 are offset with regard to the teeth of the ratchet gears 44 through half a pitch.

It will be evident from the above description that during reciprocation of the two pistons 12 and 13 in the respective cylinder bores 8' and 9' the shaft will be continuously rotated and a threaded connector engaged in the socket 24 will be correspondingly turned to be tightened or loosened. During such turning of a threaded connector in one direction, a turning moment will be created tending to turn the hydraulic wrench in the opposite direction. Means are, therefore, provided to counteract this turning moment produced on the wrench, and these means comprise a plate 50 mounted with a slide fit in an opening 52 provided in the main portion 4 of the housing. The plate 50 extends parallel to the shaft 23 beyond the housing 2 and is adapted to engage with a lower end portion thereof a stationary abutment, for instance an additional threaded connector adjacent to that to be turned by the wrench.

As mentioned before, the shaft 23 is mounted with a slide fit in the sleeve 22 provided in the side plate 6 so that after removing of the socket 24 from the projecting end of the shaft 23 the latter may be shifted in axial direction to project with an end portion thereof beyond the other side plate so that the wrench may be turned through 180° in order, for instance, to loosen a threaded connector. The plate 50 has to be shifted correspondingly and for this purpose the plate 50 is provided on one face thereof with a rack 54 engaged by two gears 56 turnably mounted along aligned axes in the main housing portion 4. To facilitate the turning of the gears 56 by the fingers of the operator, the housing portion 4 is provided with appropriate cutouts 58 and the gears 56 project with portions thereof beyond the bottom faces of these cutouts. A pair of spring loaded ball catches 60 are provided in the main housing portion 4 to cooperate with spherical indentations 62 provided in the corresponding face of the plate 50 to hold the latter in either of the shifted positions thereof.

Figure 4:
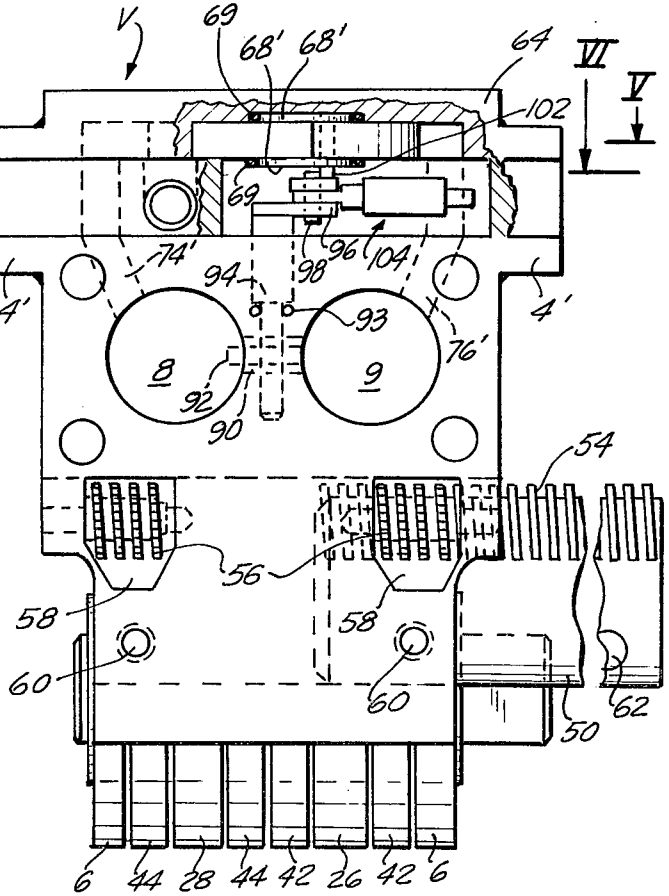
FIG. 4 is a rear view with portions of the housing broken away.
Figure 2:
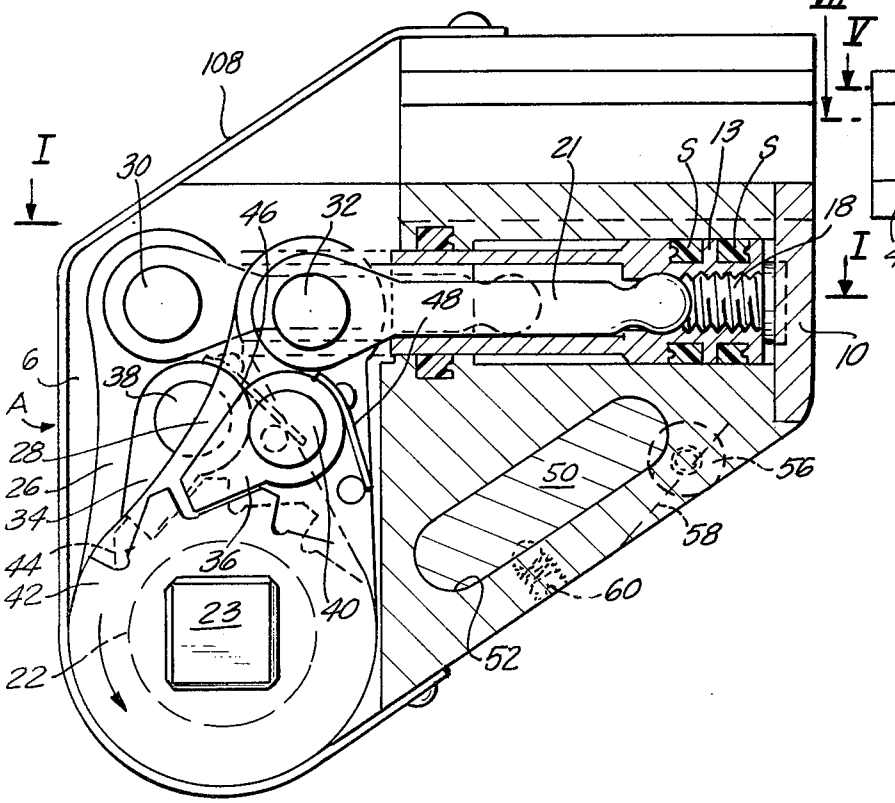
FIG. 2 is a cross-section taken along the line II—II of FIG. 1.

To alternatingly feed pressure fluid, for instance oil, into one of the cylinder bores while discharging at the same time pressure fluid from the other of the cylinder bores, valve means V are provided, which are preferably mounted on the main portion of the housing, as best shown in FIGS. 2 and 4. For this purpose the main portion 4 of the housing is provided with laterally projecting flanges 4' (FIG. 4) and the valve V is provided with corresponding flanges so that the valve V may be fixed to the upper planar end of the main portion 4 of the housing by screws, not shown in the drawing, extending through bores 4'' in these flanges.

Figure 5:
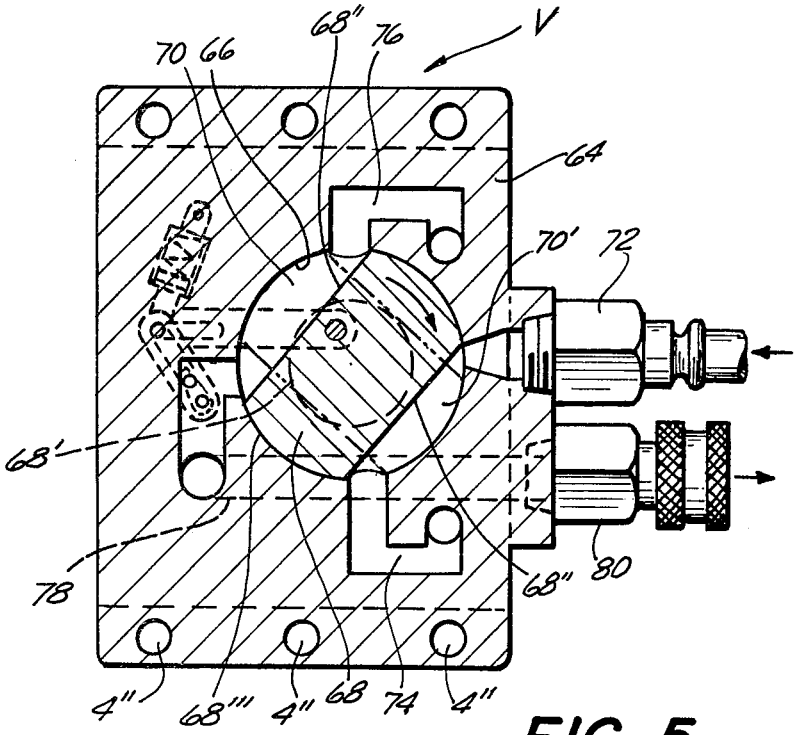
FIG. 5 is a cross-section taken along the line V—V of FIG. 4.
Figure 6:
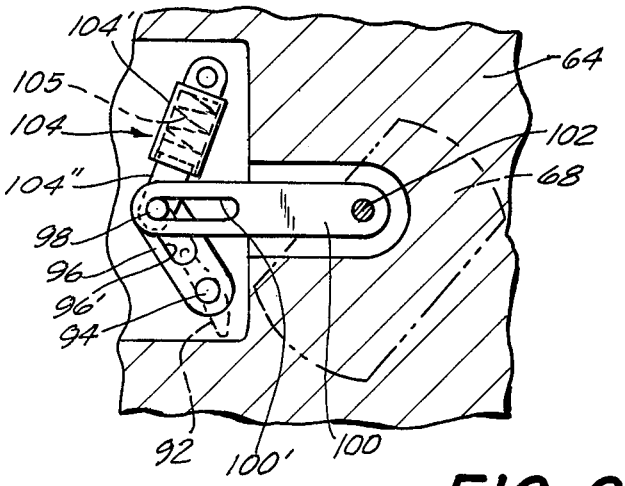
FIG. 6 is a cross-section taken along the line VI—VI of FIG. 4.

Various types of valves may be used for the aforementioned purpose and a preferred valve arrangement and the members connected thereto for the operation thereof are illustrated in FIGS. 4, 5 and 6. As shown therein, the valve V comprises a valve housing 64 provided with a cylindrical opening 66 in which a valve member 68 is turnably mounted by having a pair of short cylindrical axial extensions 68' of a diameter smaller than that of the cylindrical opening 66 and being turnably mounted in corresponding cutouts of the valve housing 64. A pair of sealing rings 69 are preferably arranged about the cylindrical projections 68'. The valve member 68 has a pair of parallel side faces 68'' connected to each other by part-cylindrical end faces 68''' engaging with a slide fit the periphery of the cylindrical cutout 66 so as to leave in the cylindrical cutout 66 to opposite side of the side faces 68'' of the valve member 68 a pair of free spaces 70 and 70'. An inlet socket 72 connected at its outer end to a source of fluid under pressure, not shown in the drawing, communicates in the position of the valve member 68 shown in FIG. 5 with one end of the space 70', whereas the other end of this space communicates through a passage 74 provided in the housing 64 of the valve V and through a passage 74' in the main portion 4 of the housing 2 of the wrench with the cylinder bore 8 adjacent to the closed rear end thereof.

In this position of the valve member 68 as shown in FIG. 5, the space 70 to the other side of the valve member communicates at one end with a passage 76 formed in the housing 64 of the valve V and a passage 76' communicating therewith and formed in the main portion 4 of the housing 2 of the wrench leading to the cylinder bore 9 adjacent to the closed rear end thereof. The other end of the space 70 communicates with a passage 78 formed in the valve housing 64 and the passage 78 leads at its outer end to an outlet socket 80. The piston 13 will thus produce its active forward stroke and the piston 12 will move along its return stroke.

When the piston 13 reaches the end position of the forward stroke and the piston 12 reaches the end of its return stroke, the valve member 68 has to be turned in clockwise direction as indicated by the arrow X in clockwise direction so that the space in the cylinder bore 9 rearwardly of the piston 13 therein will communicate with the outlet socket 80 and the space in the cylinder bore 8 rearwardly of the piston 12 therein communicates with the inlet socket 72.

In order to turn the valve member 68 between the two positions thereof, there is provided in the main portion 4 of the housing a cutout 90 in the region of the left ends of the large diameter cylinder bore portions 8' and 9' and providing communication between these two cylinder bore portions and an angled lever 92 fixedly mounted on a shaft 94 is located in this cutout 90, to project in the position shown in FIG. 1 with one of the ends thereof into the paths of the bevelled front shoulder 19 of the piston 13. The shaft 94 is turnably mounted in a corresponding bore of the main portion 4 of the wrench housing and projects with an upper end portion thereof into a cutout formed in the housing 64 of the valve member V. A sealing ring 93 is preferably arranged about a lower portion of the shaft 94 adjacent to the cutout 90. An arm 96 fixed to the upper end of the shaft 94 projects transversely to the axis thereof and this arm 96 is formed with a longitudinal slot 96'. A pin 98 extends with an end portion thereof into the slot 96' and with an opposite end portion thereof into a slot 100' extending in longitudinal direction through another arm 100 pivotally connected at the end thereof distant from the slot 100' by a pin 102 to the bottom face of the valve member 68 eccentric to the center thereof. A spring jacket 104 comprising a cylindrical housing 104' pivotally connected at one end to the valve housing 64, a small piston 104'' projecting with a portion thereof beyond the other end of the housing of the spring jacket 104 and a compression spring 105 between the piston 104'' and the closed end of the spring jacket housing 104' is also provided in the cutout of the valve housing and the small piston 104' is pivotally connected to the pin 98 intermediate the adjacent ends of the arms 96 and 100.

To facilitate machining of the various channels and cutouts in the valve housing 64, the latter is split into an upper part and a lower part along a split line 64'.

Assuming the valve member 68 is in the position as shown in FIG. 5, pressure fluid will be fed as mentioned above into the cylinder bore 9' rearwardly of the piston 13 therein so that the latter will perform its forward stroke. It will also be noted from FIG. 1 that the angled lever 92 extends with one end into the path of the front bevel 19 of the piston 13 so that when the latter moves forwardly it will turn the angled lever 92 in clockwise direction. This in turn will move the arm 96 connected to the upper end of the shaft 94 likewise in clockwise direction, but during the first part of this movement the arm 100 will not be shifted in longitudinal direction since the pin 98 on the free end of the arm 96 will during the first part of turning movement of the latter move in the slots 96' and 100' respectively provided in the arms 96 and 100. During this first part of turning of the angled lever 92 the spring jacket 104 will also tilt in counterclockwise direction, while the compression spring 105 is compressed and after the spring jacket passes its dead-center position the compressed spring will suddenly expand so that the pin 98 will shift suddenly to the other end of the slot 100' to thereby move the arm 100 towards the right, as viewed in FIG. 6, to turn thereby the valve member 68 from the position shown in full lines in FIG. 5 to the position shown in dash-dotted lines therein, so that the cylinder bore 8' rearwardly of the piston 12 will be connected to the inlet socket 72 while the cylinder bore 9' rearwardly of the piston 13 will be connected to the outlet socket 80. It will also be noted that during the forward stroke of the piston 13 oil in the annular space 106 between the outer surface of the tubular extension 13' of the piston 13 and the surface of the bore 9' will pass through the cutout 90 into the corresponding annular space about the tubular extension 12' of the piston 12, so that as the piston 13 carries out its forward stroke the piston 12 will carry out its rearward stroke. The bevel 19 provided on the front end of each piston will facilitate passing of the pressure fluid into the aforementioned annular space, even if the piston is in its most forward position. In this way the valve member 68 will be automatically turned during reciprocation of the pistons 12 and 13 to alternatingly feed pressure fluid into the respective cylinder bore rearwardly of one of the pistons while simultaneously connecting the cylinder bore rearwardly of the other of the piston to the outlet, and vice versa. Of course, it is to be understood that a closer valve, not shown in the drawing, has to be connected to the fluid line communicating with the inlet socket 72 to shut off operation of the wrench.

Preferably a sheet metal cover 108 is connected to the valve member V and the main portion of the housing 2, as shown in FIG. 2, to cover the ratchet drive.

As mentioned before, the strokes of the pistons 12 and 13 are held relatively short so that the drive arms 26 and 28 will tilt through a relatively small angle to hold the variations in the torque provided by the wrench smaller than in such wrenches known in the art. The total length of the stroke of each piston is made in such a manner that each of the drive arms 26 and 28 will be turned through an angle between 20° and 25° and preferably through an angle of 23°, which will keep the variations of the torque to 2%.

It will be understood that each of the elements described above, or two or more together, may also find a useful application in other types of hydraulic wrenches differing from the types described above.

While the invention has been illustrated and described as embodied in a hydraulic wrench provided with two parallel cylinder bores in which axially offset pistons are reciprocatable to thereby drive over two ratchet drives having ratchet gears, the teeth of which are displaced in circumferential direction through half a pitch to continuously rotate a shaft connected to the ratchet gears for rotation therewith, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A hydraulic wrench comprising a housing having a main portion and a portion projecting forwardly from said main portion; a pair of parallel cylinder bores in said main portion of said housing, having each an open front end and a closed rear end; a pair of axially displaced piston means respectively mounted in said cylinder bores movable between an active forward stroke and a return stroke, said piston means forming with said closed ends of said bores a pair of compartments; a pair of piston rods, each pivotally connected at one end to a respective one of said pair of piston means; a shaft mounted on said projecting housing portion for rotation about an axis substantially normal to said cylinder bores and transversely spaced therefrom; a pair of ratchet gear means fixed to said shaft for rotation therewith, each of said ratchet gear means having the same number of teeth, with the teeth of one of said ratchet gear means displaced in circumferential direction relative to those of the other ratchet gear means substantially through half a pitch; a pair of drive arms each pivotally mounted at one of the ends thereof on said shaft and pivotally connected at the other end thereof to the other end of a respective one of said piston rods; a pair of pawl means respectively pivotally connected to said drive arms intermediate the ends of the latter and respectively engaging the teeth of said pair of ratchet gear means for rotating said shaft during movement of each of said piston means along its active forward stroke; an exchangeable socket connected to an end portion of said shaft projecting beyond said ratchet gear means mounted thereon for turning a threaded connector engaged in said socket during rotation of said shaft, whereby during such turning of the threaded connector in one direction a force is created tending to turn said housing about the axis of said shaft in the opposite direction; means on said main portion of said housing and adapted to engage a fixed abutment adjacent to the threaded connector to be turned for counteracting said force; and valve means in communication with said compartments for alternatingly feeding pressure fluid into one of said compartments and for discharging pressure fluid from the other compartment so that during the return stroke of one of the piston means the other of said piston means will perform its active forward stroke, whereby said shaft is continuously rotated.

2. A hydraulic wrench as defined in claim 1, wherein said projecting portion of said housing comprises a pair of side plates projecting transversely spaced from each other forwardly from said main housing portion, said ratchet gear means and said drive arms being arranged between said side plates and said end portion of said shaft projecting beyond one of said side plates.

3. A hydraulic wrench as defined in claim 1, wherein each of said piston means comprises a rear portion in which the one end of the respective piston rod is pivotally mounted and a tubular front portion projecting forwardly therefrom and surrounding part of the respective piston rod with clearance.

4. A hydraulic wrench as defined in claim 3, wherein said tubular front portion has a diameter smaller than that of the rear portion of each piston means so as to form a shoulder at the junction of said piston portions, and wherein each of the cylinder bores has a large diameter bore portion in which said rear portion of the respective piston means is guided and a small diameter end portion in which said projecting tubular front port of each piston means is guided, and wherein at the junction of said bore portions a shoulder is formed cooperating with said shoulder at the junction of said piston portions for limiting the active forward stroke of each piston means.

5. A hydraulic wrench as defined in claim 1, wherein each of said pair of ratchet gear means comprises two ratchet gears located at opposite sides of the respective drive arm and having teeth aligned in axial direction with each other, and wherein each of said pawl means comprises two pawls located at opposite sides of the respective drive arm and respectively engaging the teeth of the two ratchet gears.

6. A hydraulic wrench as defined in claim 5, wherein the other end of each piston rod is forked-shaped and wherein the other end of each drive arm is pivotally mounted in the fork-shaped end of the respective piston rod.

7. A hydraulic wrench as defined in claim 1, wherein said means for counteracting said force comprises a plate connected parallel to said shaft to said main portion of the housing and projecting laterally therefrom to the same side as said end portion of said shaft.

8. A hydraulic wrench as defined in claim 7, wherein said main portion of said housing is provided with an elongated opening therethrough extending parallel to the axis of said shaft, said plate being guided in said opening for movement between a first position projecting with an end portion thereof to one side of said housing and a second position projecting with an opposite end portion thereof beyond said other side of said housing, and means for fixing said plate in said opening in either of said positions.

9. A hydraulic wrench as defined in claim 8, and including cooperating means on said housing and said plate for moving the latter between said positions thereof.

10. A hydraulic wrench as defined in claim 9, wherein said cooperating means comprises a rack formed in said plate and having uniformly spaced teeth inclined at an acute angle to the longitudinal direction of said plate and at least one gear cooperating with the teeth of said rack for moving said plate in longitudinal direction.

11. A hydraulic wrench as defined in claim 10, wherein said at least one gear is mounted in said main portion of said housing turnable about an axis extending parallel to that of said shaft, said housing is provided in the region of said gear with a cutout into which a portion of said gear extends to facilitate turning thereof by the fingers of an operator.

12. A hydraulic wrench as defined in claim 1, wherein said valve means is mounted on said main portion of said housing.

13. A hydraulic wrench as defined in claim 12, wherein said valve means comprises a valve member turnable between a first position feeding pressure fluid into one of said compartments while discharging pressure fluid from the other of said compartments and a second position feeding pressure fluid into said other compartment while discharging pressure fluid from said one compartment.

14. A hydraulic wrench as defined in claim 13, and including means cooperating with the piston means and operatively connected to said valve member for turning the latter between said positions thereof when either of said piston means reaches the end of its active stroke.

15. A hydraulic wrench as defined in claim 1, wherein the strokes of said piston means are limited to such an extent to turn each of the drive arms through a total angle of between 20°–25° to limit the variations of the torque provided by the wrench to about ±2°.

16. A hydraulic wrench as defined in claim 4, wherein an annular space filled with oil is formed between the outer surface of each tubular front portion of each piston means and the surface of the large diameter bore portion, and including a cutout in said main housing portion providing communication between said large diameter bore portions of each bore closely adjacent to the shoulder at the junction of the large diameter and the small diameter bore portion, so that during the active forward stroke of one of said piston means oil will flow through said cutout from the annular space about the tubular front portion thereof into the annular space about the tubular front portion of the other piston means to cause movement of the latter along its return stroke.

* * * * *